US005905236A

United States Patent [19]

Green

[11] Patent Number: 5,905,236

[45] **Date of Patent: *May 18, 1999**

[54] CIRCUIT BREAKER MOVABLE ACTUATOR BLOCKING AND SECURING APPARATUS, MEANS AND SYSTEM

[75] Inventor: Russell B. Green, Douglasville, Ga.

[73] Assignee: Siemens Energy & Automation, Inc., Alpharetta, Ga.

[ * ] Notice: This patent is subject to a terminal disclaimer.

[21] Appl. No.: 08/881,322

[22] Filed: Jun. 25, 1997

[51] Int. Cl.[6] ..... H01H 9/28

[52] U.S. Cl. ..... 200/43.14; 200/43.16

[58] Field of Search ..... 200/43.14, 43.15, 200/43.16, 43.19, 43.21

[56] References Cited

U.S. PATENT DOCUMENTS

| | | | |
|---|---|---|---|
| 4,260,861 | 4/1981 | DiMarco | 200/42 T |
| 4,677,261 | 6/1987 | Nourry | 200/43.15 |
| 4,882,456 | 11/1989 | Hovanic et al. | 200/43.15 |
| 4,978,816 | 12/1990 | Castonguay et al. | 200/43.14 |
| 5,207,315 | 5/1993 | Benda | 200/43.11 |
| 5,290,979 | 3/1994 | Grass | 200/43.19 |

*Primary Examiner*—Wynn Wood Coggins
*Assistant Examiner*—Michael J. Hayes

[57] ABSTRACT

A circuit breaker movable actuator locking apparatus, means and system for use with a circuit breaker assembly, where the circuit breaker assembly has a movable actuator that is movable at least between at least a first position and a second position for actuating the circuit breaker to at least a first state and a second state, the circuit breaker movable actuator locking apparatus including: a main frame member, wherein the main frame member comprises a main frame fastening member that is adapted to fasten the main frame member with respect to the movable actuator; a first sub-frame member, wherein the first sub-frame member is adapted to be movably associated with the main frame member, and wherein the first sub-frame member comprises at least one first sub-frame fastening member that is adapted to fasten the main frame member with respect to the movable actuator; a second sub-frame member, wherein the second sub-frame member is adapted to be movably associated with the main frame member, and wherein the second sub-frame member has a blocking member that is adapted to block substantial movement of the movable actuator at least between its at least first and second positions.

30 Claims, 5 Drawing Sheets

CIRCUIT BREAKER MOVABLE ACTUATOR BLOCKING AND SECURING APPARATUS, MEANS AND SYSTEM

BACKGROUND OF THE INVENTION

1. Field of the Invention

The inventions described in this application relate to an apparatus, means, system and method for blocking and locking or otherwise securing, without the use of tools, tamper-resistant screws or other fasteners, a circuit breaker movable actuator, such as an operating or toggle handle, so as to better prevent the intentional or unintentional substantial displacement or movement of the circuit breaker movable actuator at least between its at least two positions, such as its ON or OFF positions, so as to prevent the circuit breaker from being switched at least between its at least two operating states, such as its ON and OFF states. The circuit breaker movable actuator blocking and securing apparatus or means may use at least up to four padlocks or any other suitably appropriate locking or securing apparatus or device.

Thus, the inventions are believed to provide a relatively elegant, cost effective and reliable apparatus, means, system and method for blocking and locking or otherwise securing, without the use of tools, tamper-resistant screws or other fasteners, a circuit breaker movable actuator so as to better prevent the intentional or unintentional substantial displacement or movement of the circuit breaker movable actuator at least between its at least two positions, such as its ON or OFF positions.

2. Background

In certain industrial applications, circuit breakers may be locked in the OFF position to allow for electrical or mechanical repairs so as to better prevent the circuit breaker being set from its OFF state to its ON state. Electric utility companies may lock circuit breakers in the OFF state to prevent the unauthorized use of power.

One known device includes that shown in U.S. Pat. No. 4,260,861, which is entitled "Handle Locking Means For Circuit Breaker" ("the '861 patent"). This device may be described as using a "scissor" type locking arrangement. When the circuit breaker operating or toggle handle locking device is attached to a circuit breaker, its removal is generally prevented by two tamper resistant screws 81 and 82 as shown in FIG. 2 of the '861 patent. The circuit breaker operating or toggle handle may be locked by sliding a blocking member 50 between side members of frame members 10 and 30, all of which are components of the handle locking device of the '861 patent, until holes 63 and 64 are aligned respectively with holes 23, 43 and 24, 44. To prevent the circuit breaker operating or toggle handle from being moved from its OFF position to its ON position, a padlock bail 80 may then be inserted as follows: though holes 23, 43 and 63; through holes 24, 44 and 64; or if the padlock bail is sufficiently long, through holes 23, 43, 63, 24, 44 and 64. To prevent the circuit breaker operating or toggle handle being moved from its ON position to its OFF position, however, pilot holes 83 and 84 must be enlarged, such as by drilling, to the diameter of holes 85 and 86 so that a padlock bail 80 may be inserted therethrough.

Some potential limitations of the above approach are as follows. The above approach may not allow for the use of circuit breaker operating or toggle handle extensions.

Also, special tools for the tamper resistant screws may be required to install and remove the handle locking device referred to above. Further, to padlock the circuit breaker operating or toggle handle in its ON position, the pilot holes must be enlarged, such as by drilling, so that a padlock bail may be inserted therethrough. Finally, if the padlock bail is not sufficiently large, the circuit breaker operating or toggle handle locking device may not be sufficiently secure.

SUMMARY OF THE INVENTION

It is an object of the present invention to overcome the limitations or problems of at least certain of the known approaches.

Another object is to provide, for use with a circuit breaker assembly having an operating handle that is movable within an aperture in a casing of the circuit breaker assembly to plural positions for operating the circuit breaker assembly to corresponding states of operation, a locking apparatus for selectively preventing the handle from being operated from one of the positions to another of the positions, the locking apparatus comprising: a main frame, comprising an open center, for disposition on the casing with the open center in registration with the aperture and with the handle; a first sub-frame; a second sub-frame comprising a blocking member for blocking operation of the handle from the one position to the another position; a connection between the main frame and the first sub-frame providing for the first sub-frame to be selectively manipulated relative to the main frame to an attaching position for attaching the main frame to the casing at the aperture with the open center in registration with both the aperture and the handle and to a non-attaching position for allowing the main frame to be detached from the casing; the first sub-frame comprising an open center that is in registration with the open center of the main frame when the first sub-frame is in attaching position relative to the main frame; a hinge connection between the main frame and the second sub-frame providing for the second sub-frame to be selectively pivoted on the main frame for swinging motion relative both to the main frame and to the first sub-frame, when the first sub-frame is in attaching position relative to the main frame, to a blocking position wherein the blocking member is disposed in registration with the open centers of the main frame and the first sub-frame and in blocking relationship to the operating handle for blocking operation of the handle from the one position to the another position, and to a non-blocking position wherein the blocking member is disposed in non-blocking relationship to the handle for allowing operation of the handle from the one position to the another position.

Another object is to provide, for use with a circuit breaker assembly having an operating handle that is movable within an aperture in a casing of the assembly to plural positions for operating the circuit breaker assembly to corresponding states of operation, a locking apparatus for selectively preventing the handle from being operated from one of the positions to another of the positions, the locking apparatus comprising: attachment frame structure comprising first and second attachment frame parts providing an open center, for attaching to the casing at the aperture with the open center in registration with the aperture and with the handle; a sub-frame part comprising a blocking member for blocking operation of the handle from the one position to the another position; a hinge connection between the attachment frame structure and the sub-frame part providing for the sub-frame part to be selectively pivoted relative to the attachment frame structure about a hinge axis to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position; wherein the sub-frame part comprises a side that extends radially from its hinge connection with the attachment frame structure, and the blocking member comprises a bar that extends transversely from the side of the sub-frame part at a location that is spaced from the hinge connection of the sub-frame part with the attachment frame structure; and further including a tab that extends transversely from the bar at a location that is spaced from the side of the sub-frame part, and a frangible connection connecting the tab with the bar to allow the tab to be severed from the bar at the frangible connection.

Another object is to provide, for use with a circuit breaker assembly having an operating handle that is movable within an aperture in a casing of the assembly to plural positions for operating the circuit breaker assembly to corresponding states of operation, a locking apparatus for selectively preventing the handle from being operated from one of the positions to another of the positions, the locking apparatus comprising: attachment frame structure comprising first and second attachment frame parts providing an open center, for attachment to the casing at the aperture with the open center in registration with the aperture and with the handle; a sub-frame part comprising a blocking member for blocking operation of the handle from the one position to the another position; a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position; wherein the blocking member comprises a bar that is disposed transverse to a direction of operation of the operating handle from the one position to the another position; and further including a tab that extends transversely from the bar in registration with the aperture and a frangible connection connecting the tab with the bar to allow the tab to be severed from the bar at the frangible connection.

Another object is to provide, for use with a circuit breaker assembly having an operating handle that is movable within an aperture in a casing of the assembly to plural positions for operating the circuit breaker assembly to corresponding states of operation, a locking apparatus for selectively preventing the handle from being operated from one of the positions to another of the positions, the locking apparatus comprising: attachment frame structure, comprising an open center, for attaching to the casing at the aperture with the open center in registration with the aperture and with the handle; a sub-frame part comprising a blocking member for blocking operation of the handle from the one position to the another position; a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position; the attachment frame structure comprising two attachment frame parts, the two attachment frame parts including a connection providing for their selective manipulation to an attaching position for attaching the attachment frame structure to the casing with the open center in registration with both the aperture and the handle, and to a non-attaching position for allowing the attachment frame structure to be detached from the casing; and the connection between the two attachment frame parts comprising a hinge connection for pivotally connecting the two attachment frame parts for their manipulation between the attaching and non-attaching positions, and a catch connection for catching one of the two attachment frame parts to the other of the two attachment frame parts as the two attachment frame parts pivot into the attaching position.

Another object is to provide circuit breaker and locking apparatus comprising: an assembly comprising a circuit breaker having an operating handle that is movable to plural positions for operating the circuit breaker to corresponding states of operation; and locking apparatus, attached to the assembly, for selectively preventing the handle from being operated from one of the positions to another of the positions; the locking apparatus comprising a main frame having an open center disposed in registration with the handle, a first sub-frame, and a second sub-frame; the first sub-frame comprising an open center that is in registration with the open center of the main frame; the main frame and the first sub-frame providing a detachable attachment of the locking apparatus to the assembly, including a connection between the main frame and the first sub-frame providing for the first sub-frame to be selectively manipulated relative to the main frame for detaching the locking apparatus from the assembly; the second sub-frame comprising a blocking member for blocking operation of the handle from the one position to the another position; a hinge connection between the main frame and the second sub-frame providing for the second sub-frame to be selectively pivoted on the main frame for swinging motion relative both to the main frame and to the first sub-frame, while both the main frame and the first sub-frame reside in attachment of the locking apparatus to the assembly, to a blocking position wherein the blocking member is disposed in registration with the open centers of the main frame and the first sub-frame and in blocking relationship to the operating handle for blocking operation of the handle from the one position to the another position, and to a non-blocking position wherein the blocking member is disposed in non-blocking relationship to the handle for allowing operation of the handle from the one position to the another position.

Another object is to provide circuit breaker and locking apparatus comprising: an assembly comprising a circuit breaker having an operating handle that is movable to plural positions for operating the circuit breaker to corresponding states of operation; and locking apparatus for preventing the handle from being operated from one of the positions to another of the positions; the locking apparatus comprising attachment frame structure that comprises first and second frame parts providing an open center in registration with the handle; the locking apparatus further comprising a sub-frame part comprising a blocking member for blocking operation of the handle from the one position to the another position; a hinge connection between the attachment frame structure and the sub-frame part providing for the sub-frame part to be selectively pivoted relative to the attachment frame structure about a hinge axis to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position; wherein the sub-frame part comprises a side that pivots about its hinge connection with the attachment frame structure and the blocking member comprises a bar that extends transversely from the side at a location spaced from the hinge connection of the sub-frame part with the attachment frame structure; and further including a tab that extends transversely from the bar at a location that is spaced from the side of the sub-frame part, and a frangible connection connecting the tab with the bar to allow the tab to be severed from the bar at the frangible connection.

Another object is to provide circuit breaker and locking apparatus comprising: an assembly comprising a circuit breaker having an operating handle that is movable to plural positions for operating the circuit breaker to corresponding states of operation; and locking apparatus for preventing the handle from being operated from one of the positions to another of the positions; the locking apparatus comprising attachment frame structure comprising first and second attachment frame parts providing an open center in registration with the handle; the locking apparatus further comprising a sub-frame part comprising a blocking member for blocking operation of the handle from the one position to the another position; a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position; wherein the blocking member comprises a bar that extends transverse to a direction of operation of the operating handle from the one position to the another position; and further including a tab that extends transversely from the bar and a frangible connection connecting the tab with the bar to allow the tab to be severed from the bar at the frangible connection.

Another object is to provide circuit breaker and locking apparatus comprising: a circuit breaker assembly comprising a casing having an aperture and an operating handle that is movable within the aperture to plural positions for operating the circuit breaker assembly to corresponding states of operation; and locking apparatus for selectively preventing the handle from being operated from one of the positions to another of the positions; the locking apparatus comprising attachment frame structure that removably attaches the locking apparatus to the casing at the aperture, the attachment frame structure comprising an open center in registration with the aperture and with the handle; the locking apparatus further comprising a sub-frame part comprising a blocking member for blocking operation of the handle from the one position to the another position; a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position; the attachment frame structure comprising two attachment frame parts, and a connection between the two attachment frame parts providing for their selective manipulation to allow the locking apparatus to be detached from the casing; and the connection between the two attachment frame parts comprising a hinge connection that provides pivotal motion between the two attachment frame parts for their manipulation to allow detachment of the locking apparatus from the casing and a catch connection that catches one of the two attachment frame parts to the other of the two attachment frame parts and that comprises a tab of the one attachment frame part lodged in a tab-receiving slot of the other attachment frame part.

Another object is to provide circuit breaker and locking apparatus comprising: an assembly comprising a circuit breaker assembly having an operating handle that is movable to plural positions for operating the circuit breaker to corresponding states of operation; and locking apparatus for preventing the handle from being operated from one of the positions to another of the positions; the locking apparatus comprising attachment frame structure, comprising an open center in registration with the handle; a sub-frame part comprising a blocking member for blocking operation of the handle from the one position to the another position; a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position; wherein the blocking member comprises a bar that extends transverse to a direction of operation of the operating handle from the one position to the another position; and further including a tab that extends transversely from the bar and a frangible connection connecting the tab with the bar to allow the tab to be severed from the bar at the frangible connection.

A co-pending application of the inventor, Ser. No. 08/876,355, filed Jun. 25, 1997, involves method aspects of the invention.

These and other objects, advantages and features of the present invention will be readily understood and appreciated with reference to the detailed description of preferred embodiments discussed below together with the accompanying drawings.

DETAILED DESCRIPTION OF PREFERRED EMBODIMENT

Figure 1:
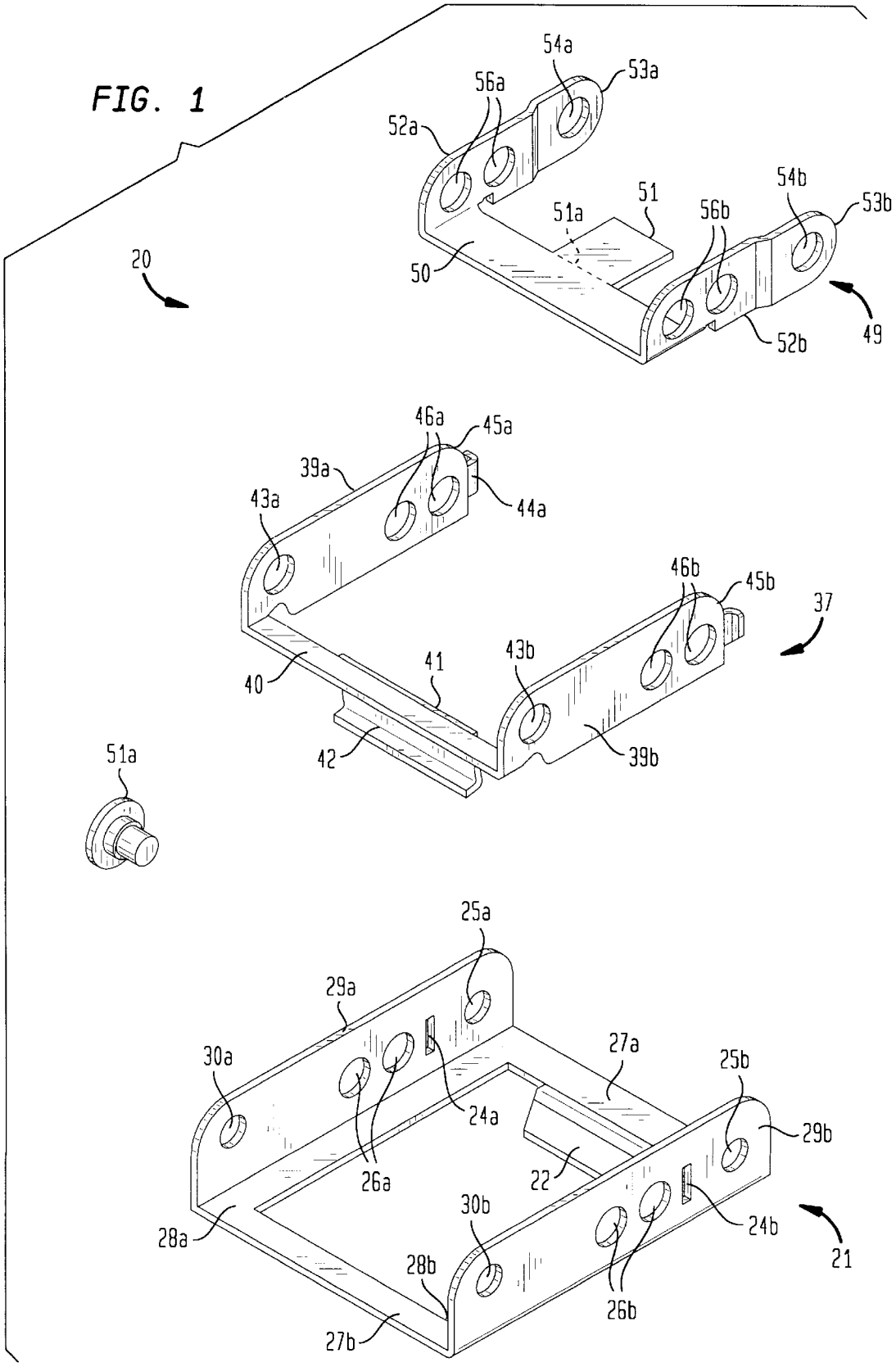
FIG. 1 is a drawing of one embodiment of the components of the circuit breaker movable actuator blocking and securing apparatus and means of the present inventions.
Figure 2:
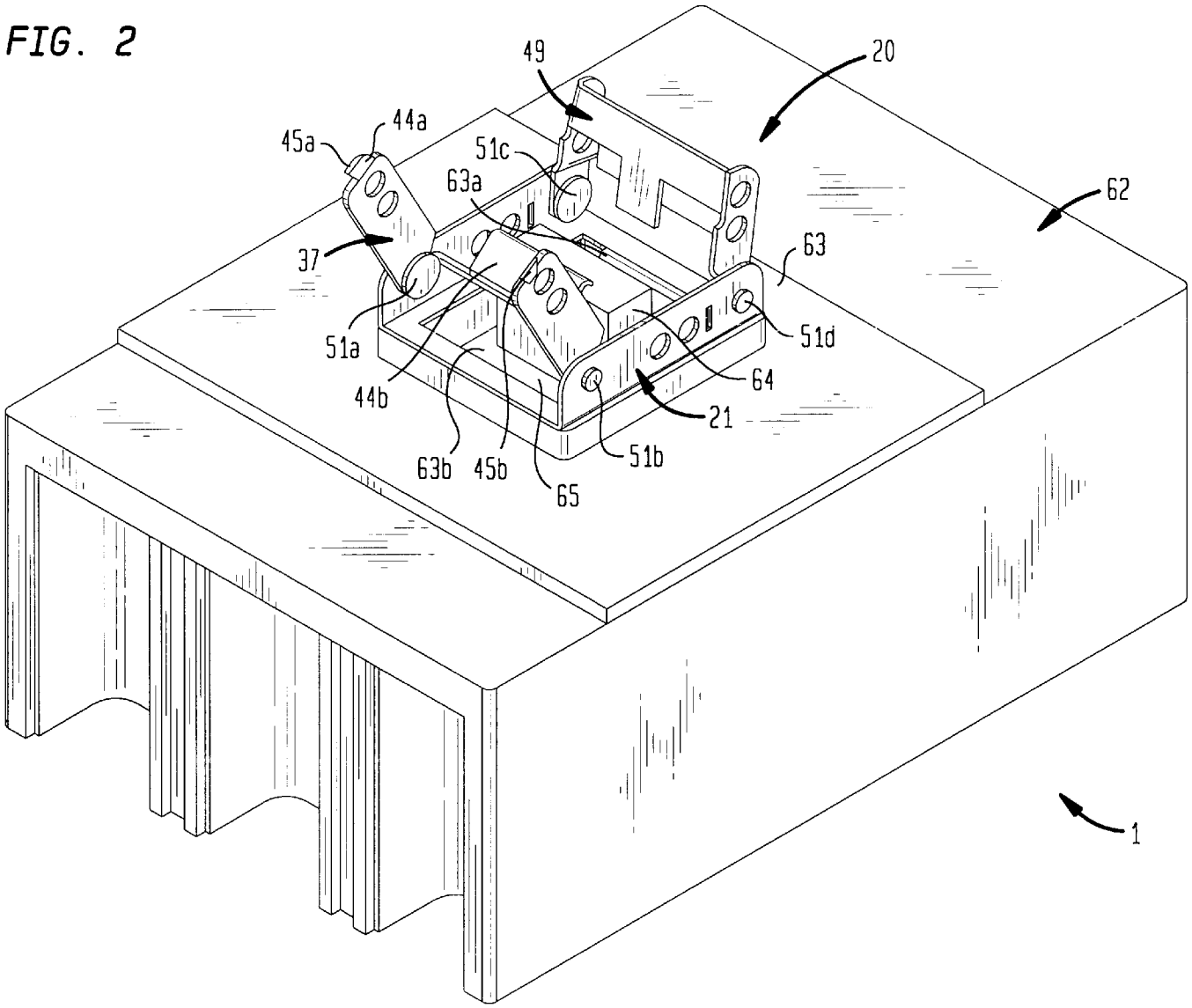
FIG. 2 is a drawing of the apparatus, means and system of the present inventions, in which the circuit breaker movable actuator blocking and securing apparatus and means is in its unblocked or open condition.
Figure 3A:
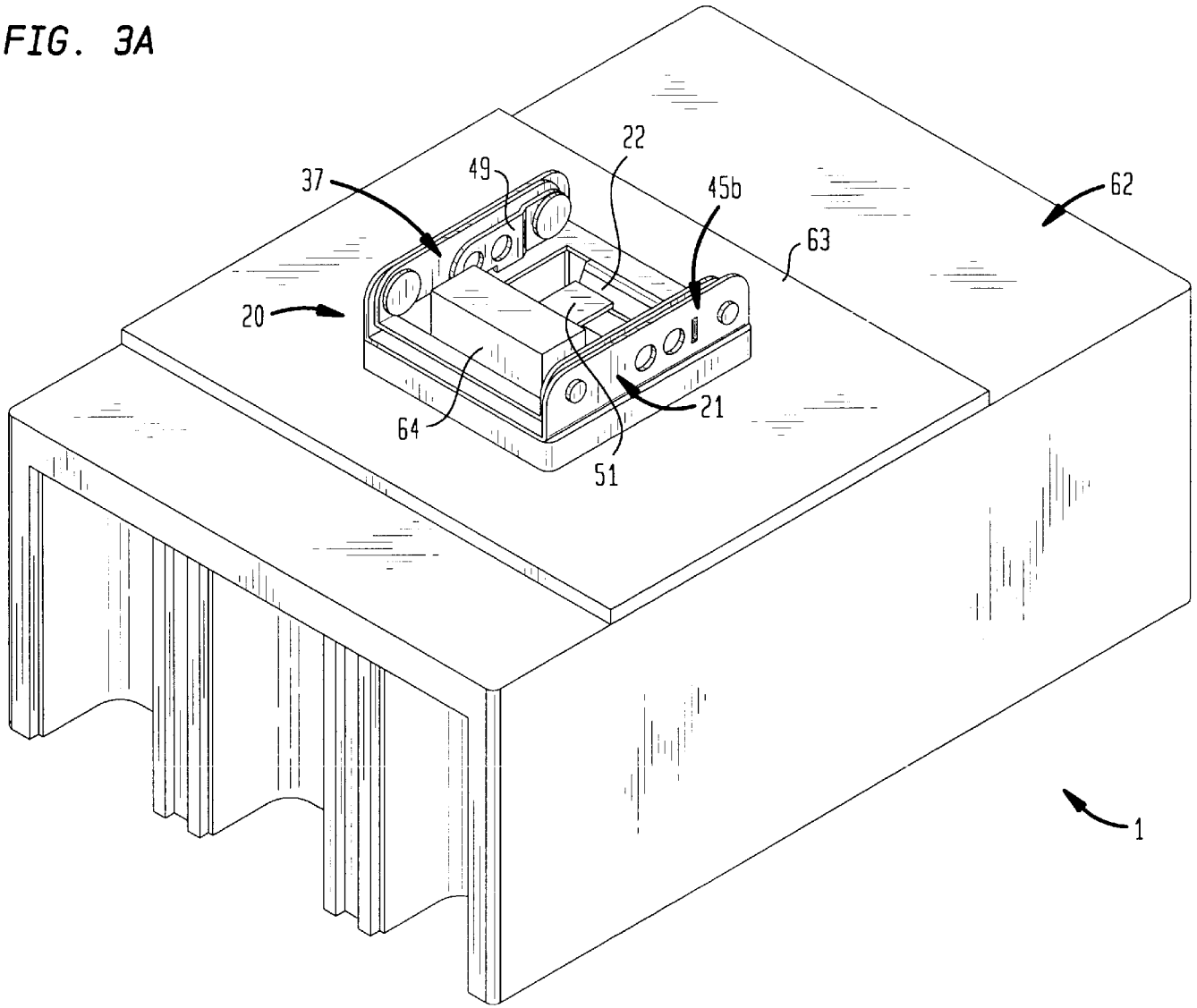
FIG. 3A is a drawing of the apparatus, means, system and method of the present inventions, in which the circuit breaker movable actuator blocking and securing apparatus and means is in its blocked or closed condition.
Figure 3B:
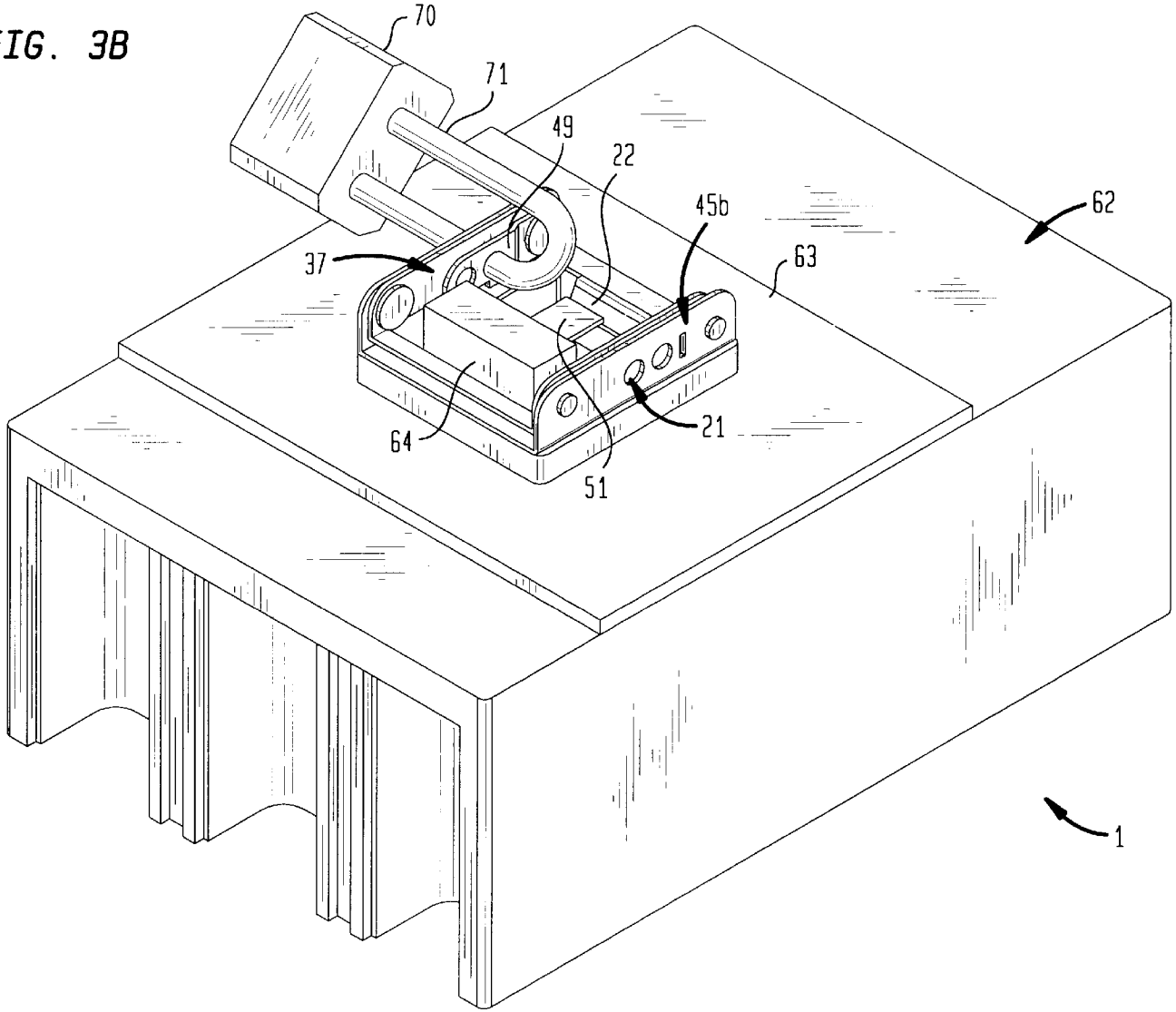
FIG. 3B is a drawing of the apparatus, means, system and method of the present inventions, in which a padlock securing device is used to place the circuit breaker movable actuator blocking and securing apparatus and means in its securely blocked or closed condition.
Figure 4:
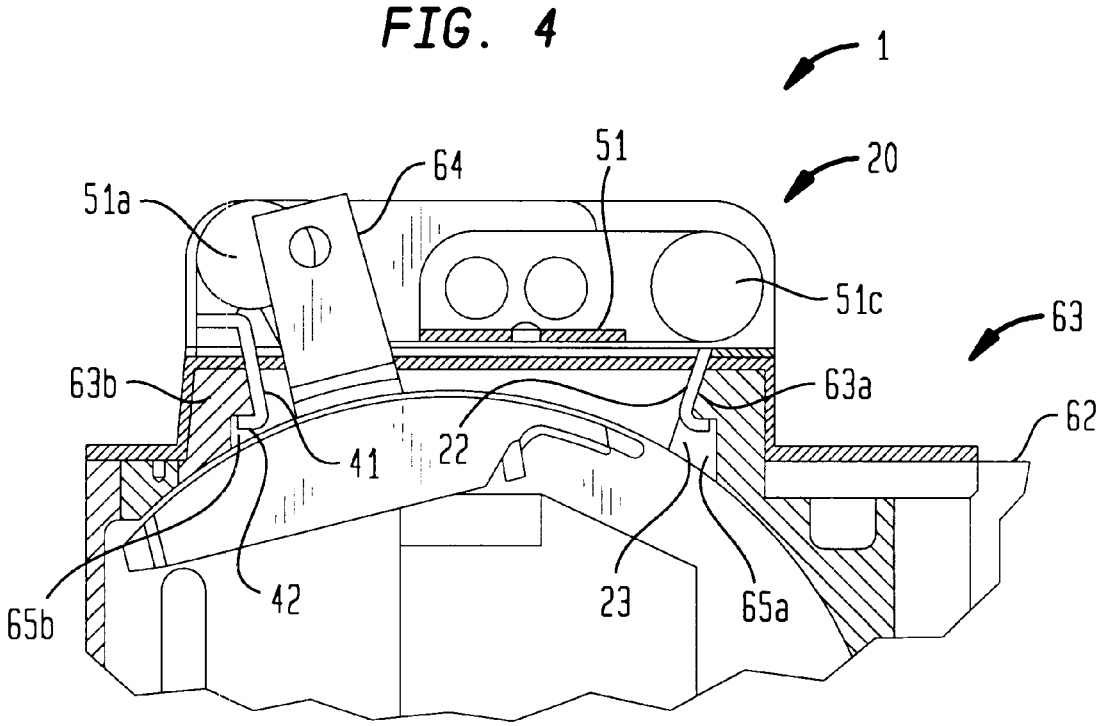
FIG. 4 is a cross-sectional view of the apparatus, means and system of the present inventions to show how the circuit breaker movable actuator blocking and securing apparatus and means is fastened to the movable actuator area of the circuit breaker assembly.

Referring to FIGS. 1 to 4, the circuit breaker movable actuator blocking and securing system 1 comprises a circuit breaker movable actuator blocking and securing apparatus, assembly or device 20 and a circuit breaker assembly 62. The circuit breaker movable actuator blocking and securing apparatus, assembly or device 20 comprises a main frame member 21, a first sub-frame member 37 and a second sub-frame member 49. Four shoulder rivets 51*a,* 51*b,* 51*c* and 51*b,* or any other suitably appropriate movable, pivotable or rotatable fastening device, are used to assemble together the main frame member 21, the first sub-frame member 37 and the second sub-frame member 49, each of which may be formed or stamped from a single piece of material. The main frame member 21, the first sub-frame member 37 and the second sub-frame member 49 are preferably made from steel, but may also be made from any other material suitably appropriate for use in securing a circuit breaker.

In particular, the main frame member 21 comprises upper horizontal main frame member 27*a* and lower horizontal main frame member 27*b,* and left vertical main frame member 28*a* and right vertical main frame member 28*b*. The main frame member 21 also comprises left flange main frame member 29*a* and right flange main frame member 29*b,* each of which is integrally associated with or otherwise associated in a suitably appropriate way with respect to main frame members 27*a,* 27*b* and 28*a,* 28*b*. As shown in FIG. 1, for example, the main frame flange members 29*a* and 29*b* are formed generally perpendicularly to vertical main frame members 28*a* and 28*b,* respectively. Upper horizontal main frame member 27*a* further comprises an upper fastening or mounting tab member or portion 22, which is integrally associated with or otherwise associated in a suitably appropriate way with respect to the lower inside edge of upper horizontal main frame member 27*a,* and which extends generally in a direction opposite to or downwardly with respect to the outwardly projecting main frame flange members 29*a* and 29*b*. Main frame flange members 29*a* and 29*b* comprise lower fastening apertures, holes or openings 30*a* and 30*b,* respectively, which are used to movably, pivotably or rotatably fasten first sub-frame member 37. Main frame flange members 29*a* and 29*b* also comprise upper fastening apertures, holes or openings 25*a* and 25*b,* respectively, which are used to movably, pivotably or rotatably fasten second sub-frame member 49. Main frame flange members 29*a* and 29*b* further comprise first sub-frame tab fastening slotted apertures or openings 24*a* and 24*b,* respectively, which are adapted to receive first sub-frame fastening tab members or portions 44*a* and 44*b,* respectively. In particular, first sub-frame tab fastening slotted apertures or openings 24*a* and 24*b* receive first sub-frame fastening tab flange members or portions 45*a* and 45*b,* respectively. Finally, main frame flange member 29*a* of main frame member 21 comprises up to at least two padlock bail or other securing device receiving apertures, holes or openings 26*a,* and main frame flange member 29*b* of main frame member 21 similarly comprises up to at least two padlock bail or other securing device receiving apertures, holes or openings 26*b*. The padlock bail or other securing device receiving apertures, holes or openings 26*a* and 26*b* are adapted to receive at least up to four padlock bails 71 of at least up to four padlocks 70 or at least a segment of at least another securing device.

The first sub-frame member 37 comprises first sub-frame lower member 40, and first sub-frame left flange member 39*a* and first sub-frame right flange member 39*b,* which are integrally associated with or otherwise associated in a suitably appropriate way with respect to first sub-frame lower member 40. As shown in FIG. 1, for example, the first sub-frame flange members 39*a* and 39*b* are formed generally perpendicularly to the first sub-frame lower member 40. First sub-frame member 37 further comprises a first sub-frame fastening or mounting tab member or portion 41, which is integrally associated with or otherwise associated in a suitably appropriate way with respect to the inside edge of first sub-frame lower member 40, and which extends generally in a direction opposite to or downwardly with respect to the outwardly projecting first sub-frame flange members 39*a* and 39*b*. First sub-frame flange members 39*a* and 39*b* comprise first sub-frame fastening apertures, holes or openings 43*a* and 43*b,* respectively, which are aligned with main frame fastening apertures, holes or openings 30*a* and 30*b,* respectively, when the circuit breaker movable actuator blocking and securing apparatus components 21 and 37 are assembled together. First sub-frame flange members 39*a* and 39*b* also comprise first sub-frame fastening tabs 44*a* and 44*b,* respectively. As discussed, the first sub-frame fastening tabs 44*a* and 44*b* have first sub-frame fastening tab flange members or portions 45*a* and 45*b,* respectively, which are inserted into first sub-frame fastening tab apertures, holes or openings 24*a* and 24*b* so as to fasten the first sub-frame member 37 with respect to main frame member 21. Tabs 44*a,* 44*b* and openings 24*a,* 24*b* constitute catches, or catching portions, providing a catch connection. Finally, first sub-frame flange member 39*a* comprises up to at least two first sub-frame padlock bail or other securing device receiving apertures, holes or openings 46*a,* and first sub-frame flange member 39*b* similarly comprises up to at least two first sub-frame padlock bail or other securing device receiving apertures, holes or openings 46*b*. The first sub-frame padlock bail or other securing device receiving apertures, holes or openings 46*a* and 46*b,* which are aligned with main frame padlock bail or other securing device receiving apertures, holes or openings 26*a* and 26*b,* respectively, are adapted to receive at least up to four padlock bails 71 of at least up to four padlocks 70 or at least a segment of at least another securing device.

The second sub-frame member 49 comprises second sub-frame lower member 50, second sub-frame left flange member 52*a* and second sub-frame right flange member 52*b*. Second sub-frame flange members 52*a* and 52*b* are integrally associated with or otherwise associated in a suitably appropriate way with respect to second sub-frame lower member 50. As shown in FIG. 1, for example, the second sub-frame flange members 52*a* and 52*b* are formed generally perpendicularly to the second sub-frame lower member 50. Second sub-frame member 49 further comprises a second sub-frame blocking tab member or portion 51, which is integrally associated with or otherwise associated in a suitably appropriate way with respect to the inside edge of second sub-frame lower member 50, and which generally extends inwardly along the same plane as second sub-frame lower member 50. Second sub-frame flange members 52*a* and 52*b* comprise second sub-frame fastening flange members 53*a* and 53*b,* respectively, which further comprise second sub-frame fastening apertures, holes or openings 54*a* and 54*b,* respectively, which are aligned with upper main frame fastening apertures, holes or openings 25*a* and 25*b,* respectively, when the circuit breaker movable actuator blocking and securing apparatus components 21 and 49 are assembled together. Finally, second sub-frame flange member 52*a* comprises up to at least two first sub-frame padlock bail or other securing device receiving apertures, holes or openings 56*a,* and second sub-frame flange member 52*b* similarly comprises up to at least two first sub-frame padlock bail or other securing device receiving apertures, holes or openings 56*b.* The second sub-frame padlock bail or other securing device receiving apertures, holes or openings 56*a* and 56*b,* which are aligned with main frame padlock bail or other securing device receiving apertures, holes or openings 26*a* and 26*b* and which are also aligned with first sub-frame padlock bail or other securing device receiving apertures, holes or openings 46*a* and 46*b,* are adapted to receive at least up to four padlock bails 71 of at least up to four padlocks 70 or at least a segment of at least another securing device, such as a securing cable with lock.

In the circuit breaker operator or toggle handle padlock system 1, the circuit breaker assembly 62, which receives the circuit breaker operating handle assembly 20, comprises an operating or toggle handle or movable actuator 64, which may have at least an ON position, a TRIPPED position and an OFF position. The circuit breaker assembly 62 further comprises a corresponding upper operating or toggle handle or movable actuator aperture or slot 65, which is located in a circuit breaker face plate or escutcheon 63 of the circuit breaker assembly 62. Below an upper portion 63*a* of the circuit breaker face plate or escutcheon 63 defining the operating handle or movable actuator aperture or opening 65, there is an upper fastening slotted area, aperture or opening 65*a.* Similarly, below a lower portion 63*b* of the circuit breaker face plate or escutcheon 63 defining the operating handle or movable actuator aperture or opening 65, there is a lower fastening slotted area, aperture or opening 65*b.* Both the upper and lower fastening slotted areas, apertures or openings 65*a* and 65*b* are adapted to receive the main frame upper fastening tab member or portion 22 and the first sub-frame lower fastening tab member or portion 41.

The circuit breaker assembly 62 may further comprise push-to-trip buttons, circuit breaker lug openings or apertures and circuit breaker mounting openings or apertures (not shown). The circuit breaker assembly 62 may include an electronic trip unit, which may further include energy measurement capabilities. Further, the circuit breaker assembly 62 may be a "single" unit, or in certain arrangements, the circuit breaker assembly 62 may also comprise a separate circuit breaker unit and a corresponding plug-in unit (not shown). In such an arrangement, threaded screws or bolts may be passed through the circuit breaker mounting apertures or openings and are received by threaded apertures or openings in the corresponding plug-in unit so as to mount the circuit breaker unit on the plug-in unit. Also, the circuit breaker lug apertures or openings may be used to receive threaded copper studs, which may be plugged into copper tulip contacts that are provided in the plug-in unit. In this way, a current path may be provided through the plug-in unit to the circuit breaker unit.

The circuit breaker movable actuator blocking and securing apparatus, assembly, device or means 20 is assembled as follows: Grasping or otherwise taking the first sub-frame member 37, it is at least partially positioned or placed within the main frame member 21 so that first sub-frame lower fastening apertures, holes or openings 43*a* and 43*b,* which are located in the lower end of the first sub-frame flange members 39*a* and 39*b,* respectively, are aligned with main frame lower fastening apertures, holes or openings 30*a* and 30*b,* respectively, when the circuit breaker movable actuator blocking and securing apparatus components 21 and 37 are assembled together. Next, shoulder rivets 51*a* and 51*b* are inserted through main frame fastening apertures, holes or openings 30*a* and 30*b,* respectively, and through first sub-frame fastening apertures, holes or openings 43*a* and 43*b,* respectively, which are aligned with main frame fastening apertures, holes or openings 30*a* and 30*b,* respectively. The inserted end of shoulder rivets 51*a* and 51*b* may then be compressed so that they are no longer removable from main frame fastening apertures, holes or openings 30*a* and 30*b,* respectively, or from first sub-frame fastening apertures, holes or openings 43*a* and 43*b,* respectively. Of course, any other suitably appropriate movable, pivotable or rotatable fastening apparatus may be used rather than the specific configuration discussed above.

Next, taking the upper end of second sub-frame member 49, it is at least partially positioned or placed within the main frame member 21 so that second sub-frame fastening apertures, holes or openings 54*a* and 54*b,* which are located in the upper end of the second sub-frame flange members 52*a* and 52*b,* respectively, are aligned with main frame upper fastening apertures, holes or openings 25*a* and 25*b,* respectively, when the circuit breaker movable actuator blocking and securing apparatus components 21 and 49 are assembled together. Next, shoulder rivets 51*c* and 51*d* are inserted through main frame upper fastening apertures, holes or openings 25*a* and 25*b,* respectively, and through second sub-frame fastening apertures, holes or openings 54*a* and 54*b,* respectively, which are aligned with main frame upper fastening apertures, holes or openings 25*a* and 25*b,* respectively. The inserted end of shoulder rivets 51*c* and 51*d* may then be compressed so that they are no longer removable from main frame upper fastening apertures, holes or openings 25*a* and 25*b,* respectively, or from the second sub-frame fastening apertures, holes or openings 54*a* and 54*b,* respectively. Of course, any other suitably appropriate movable, pivotable or rotatable fastening apparatus may be used rather than the specific configuration discussed above.

The circuit breaker movable actuator blocking and securing assembly 20 attaches to, is fastened or is otherwise mounted on the circuit breaker assembly 62 in the following way:

First, the main frame member 21 of the circuit breaker movable actuator blocking and securing assembly 20 is grasped or otherwise taken and at least its upper end is placed or positioned so as to move, place or slide the upper main frame fastening tab flange member or portion 25 of the upper main frame fastening tab member or portion 22 into a corresponding upper operating or toggle handle or movable actuator aperture, opening or slot 65*a,* which is located under the upper inner member or portion 63*a* of circuit breaker face plate or escutcheon 63, which defines the operating handle or movable actuator aperture or opening 65 therein. As this is done, the bottom face of the main frame member 21 is seated firmly with respect to or otherwise adjacent to the front or top face of the circuit breaker face plate or escutcheon 63 so as to surround the operating handle or movable actuator aperture or opening 65.

If the circuit breaker operating or toggle handle or movable actuator 64 is in its OFF position and must be locked or otherwise secured in its OFF position, the first sub-frame member 37 is then moved, pivoted or rotated about points 30*a* and 30*b* so as to move, place or slide the lower first sub-frame fastening tab flange member or portion 42 of the first sub-frame lower fastening tab member or portion 41 into a corresponding lower operating or toggle handle or movable actuator aperture, opening or slot 65*b,* which is located under the lower inner member or portion of circuit breaker face plate or escutcheon 63, which also defines the operating handle or movable actuator aperture or opening 65 therein. As the upper ends of first sub-frame flange members 39*a* and 39*b* are moved, pivoted or rotated so as to be seated firmly with respect to or otherwise adjacent to the top face of main frame vertical arm portions 28*a* and 28*b,* respectively, the first sub-frame fastening tab flange member or portions 45*a* and 45*b* of first sub-frame fastening tab members or portions 44*a* and 44*b,* respectively, snap into or otherwise fit into main frame slotted fastening tab apertures or openings 24*a* and 24*b,* respectively, thereby firmly seating the bottom face of the first sub-frame member 37 with respect to or otherwise adjacent to the top face of horizontal and vertical main fame members 27*a,* 27*b* and 28*a,* 28*b.* Finally, the second sub-frame member 49 is then moved, pivoted or rotated about points 25*a* and 25*b* so as to move, place or slide the lower arm member 50 and its blocking tab member or portion 51 on the upper side of the circuit breaker operating or toggle handle or movable actuator 64 so as to block movement of the operating handle or movable actuator 64 from its OFF position to its ON position. In this way, the lower ends of second sub-frame flange members 53*a* and 53*b* are also moved, pivoted or rotated so as to be seated firmly with respect to or otherwise adjacent to the top face of main frame vertical arm portions 28*a* and 28*b,* respectively.

Finally, as discussed, main frame flange member 29*a* of main frame member 21 comprises up to at least two padlock bail or other securing device receiving apertures, holes or openings 26*a,* and flange member 29*b* of main frame member 21 similarly comprises up to at least two padlock bail or other securing device receiving apertures, holes or openings 26*b.* First sub-frame flange members 39*a* and 39*b* similarly each comprise up to at least two first sub-frame padlock bail or other securing device receiving apertures, holes or openings 46*a* and 46*b,* respectively. Second sub-frame flange members 52*a* and 52*b* also similarly comprise up to at least two second sub-frame padlock bail or other securing device receiving apertures, holes or openings 56*a* and 56*b,* respectively. When main frame member 21 has been mounted to, fastened to or otherwise with the circuit breaker face plate or escutcheon 63 and first sub-frame member 37 and second sub-frame member 49 have been firmly seated with respect to main frame member 21, the first sub-frame padlock bail or other securing device receiving apertures, holes or openings 46*a* and 46*b* will be aligned with main frame padlock bail or other securing device receiving apertures, holes or openings 26*a* and 26*b* and also will be aligned with second sub-frame padlock bail or other securing device receiving apertures, holes or openings 56*a* and 56*b,* respectively. At least up to four padlock bails 71 of at least up to four padlocks 70 or other securing devices may then be inserted through padlock bail or other securing device receiving apertures, holes or openings 26, 46 and 56, which, as discussed, are adapted to receive at least up to four padlock bails 71 of at least up to four padlocks 70 or at least *a* segment of at least another securing device. Of course, any other suitably appropriate securing apparatus or device other than padlocks may also be used to secure the circuit breaker operating or toggle handle assembly 20 on the circuit breaker assembly 62 so that the circuit breaker operating or toggle handle or movable actuator 64 may not be moved from its OFF position to its ON position, either intentionally or unintentionally.

Figure 5:
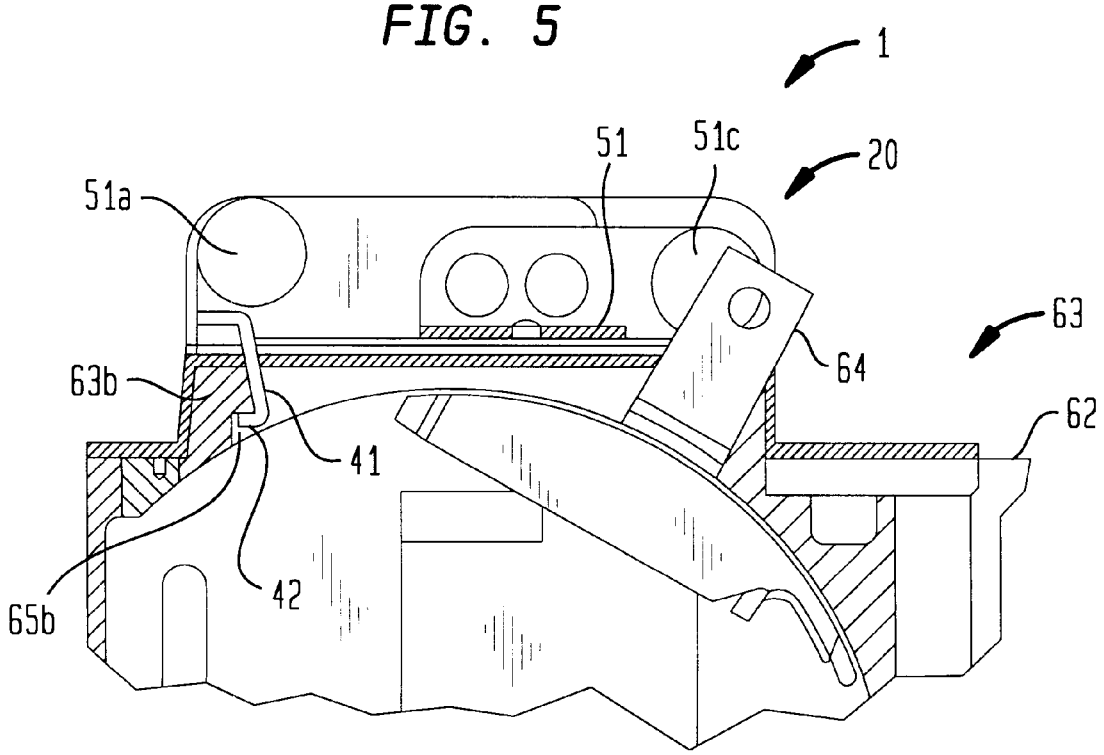
FIG. 5 is a view similar to FIG. 4 showing a modification.

If the circuit breaker operating or toggle handle or movable actuator 64 is in its ON position and must be blocked and locked or otherwise secured in its ON position, the lower blocking tab member or portion 51 must be removed from lower arm portion 50 of the second sub-frame member 49. To facilitate this operation, a break-line 51*a* at which the lower blocking tab member or portion 51 perpendicularly meets in the same plane the remainder of lower arm portion 50 may be pre-punched, scribed or otherwise weakened so as to pre-form the weakened break-line 51*a.* In this way, the lower blocking tab member or portion 51 may be bent either manually without tools or with simple tools, such as pliers, for example, so as to break off or otherwise remove the lower blocking tab member or portion 51. As before, the first sub-frame member 37 may then be moved, pivoted or rotated about points 30*a* and 30*b* so as to move, place or slide the lower fastening tab flange member or portion 42 of the first sub-frame lower fastening tab member or portion 41 into a corresponding lower operating or toggle handle or movable actuator aperture, opening or slot 65*b,* which is located under the lower inner member or portion 63*b* of circuit breaker face plate or escutcheon 63, which also defines the operating handle or movable actuator aperture or opening 65 therein. As the upper ends of first sub-frame flange members 39*a* and 39*b* are moved, pivoted or rotated so as to be seated firmly with respect to or otherwise adjacent to the top face of main frame vertical arm portions 28*a* and 28*b,* respectively, the first sub-frame fastening tab flange members or portions 45*a* and 45*b* of first sub-frame fastening tab members or portions 44*a* and 44*b,* respectively, snap or otherwise fit into main frame slotted fastening tab apertures or openings 24*a* and 24*b,* respectively, thereby firmly seating the bottom face of the first sub-frame member against the top face of horizontal and vertical main frame members 27*a,* 27*b* and 28*a,* 28*b.* Next, the second sub-frame member 49 is moved, pivoted or rotated about points 25*a* and 25*b* so as to move, place or slide the lower arm member 50 on the lower side of the circuit breaker operating or toggle handle or movable actuator 64 so as to block movement of the operating handle or movable actuator 64 from its ON position to its OFF position. This is shown by FIG. 5. In this way, the lower ends of second sub-frame flange members 52*a* and 52*b* are also moved, pivoted or rotated so as to be seated firmly with respect to or otherwise adjacent to the top face of main frame vertical arm portions 28*a* and 28*b,* respectively.

Finally, when main frame member 21 has been mounted to, fastened to or otherwise associated with the circuit breaker face plate or escutcheon 63 and first sub-frame member 37 and second sub-frame member 49 have been firmly seated with respect to or otherwise adjacent to main frame member 21, the first sub-frame padlock bail or other securing device receiving apertures, holes or openings 46*a* and 46*b* will be aligned with main frame padlock bail or other securing device receiving apertures, holes or openings 26*a* and 26*b* and also will be aligned with second sub-frame padlock bail or other securing device receiving apertures, holes or openings 56*a* and 56*b*, respectively. At least up to four padlock bails 71 of at least up to four padlocks 70 or other securing devices may then be inserted through padlock bail or other securing device receiving apertures, holes or openings 26, 46 and 56, which, as discussed, are adapted to receive at least up to four padlock bails 71 of at least up to four padlocks 70 or at least a segment of at least another securing device. Of course, any other suitably appropriate securing apparatus or device may also be used to secure the circuit breaker operating or toggle handle assembly 20 on the circuit breaker assembly 62 so that the circuit breaker operating or toggle handle or movable actuator 64 may not be moved from its ON position to its OFF position, either intentionally or unintentionally.

In light of the foregoing description of the invention with reference to the drawings, one can readily appreciate that the main frame and the first sub-frame constitute an attachment frame structure by which the blocking frame apparatus attaches to a circuit breaker assembly. If the main frame and the first sub-frame are considered first and second frame parts, then the second sub-frame may be considered a third frame part.

While the present invention has been described in connection with what are believed to be the practical and preferred embodiments as currently contemplated, it should be understood that the present invention is not limited to the specifically disclosed embodiments. Accordingly, the present invention is intended to cover various modifications and comparable arrangements, methods and structures that are within the spirit and scope of the claims.

What is claimed is:

1. For use with a circuit breaker assembly having an operating handle that is movable within an aperture in a casing of the circuit breaker assembly to plural positions for operating the circuit breaker assembly to corresponding states of operation, a locking apparatus for selectively preventing the handle from being operated from one of the positions to another of the positions, the locking apparatus comprising:

a main frame, comprising an open center, for disposition on the casing with the open center in registration with the aperture and with the handle;

a first sub-frame;

a second sub-frame comprising a blocking member for blocking operation of the handle from the one position to the another position;

a connection between the main frame and the first sub-frame providing for the first sub-frame to be selectively manipulated relative to the main frame to an attaching position for attaching the main frame to the casing at the aperture with the open center in registration with both the aperture and the handle and to a non-attaching position for allowing the main frame to be detached from the casing;

the first sub-frame comprising an open center that is in registration with the open center of the main frame when the first sub-frame is in attaching position relative to the main frame;

a hinge connection between the main frame and the second sub-frame providing for the second sub-frame to be selectively pivoted on the main frame for swinging motion relative both to the main frame and to the first sub-frame, when the first sub-frame is in attaching position relative to the main frame, to a blocking position wherein the blocking member is disposed in registration with the open centers of the main frame and the first sub-frame and in blocking relationship to the operating handle for blocking operation of the handle from the one position to the another position, and to a non-blocking position wherein the blocking member is disposed in non-blocking relationship to the handle for allowing operation of the handle from the one position to the another position.

2. Locking apparatus as set forth in claim 1 in which the connection between the main frame and the first sub-frame providing for the first sub-frame to be selectively manipulated relative to the main frame comprises a hinge connection between the first sub-frame and the main frame providing for the first sub-frame to be selectively pivoted relative to the main frame to the attaching position and to the non-attaching position, and the hinge connection between the first sub-frame and the main frame and the hinge connection between the second sub-frame and the main frame comprise respective hinge axes that are mutually parallel and are spaced apart along a direction of operation of the operating handle from the one position to the another position.

3. Locking apparatus as set forth in claim 2 in which the main frame, the first sub-frame, and the second sub-frame comprise respective hole patterns that register when the first sub-frame is in attaching position and the second sub-frame is in blocking position, whereby a bail of a locking device can be passed through registering holes in the main frame, the first sub-frame, and the second sub-frame to prevent the first sub-frame from being pivoted from attaching position and the second sub-frame from being pivoted from blocking position.

4. Locking apparatus as set forth in claim 2 in which the second sub-frame comprises a side that extends radially from its hinge connection with the main frame, and the blocking member comprises a bar that extends transversely from the side of the second sub-frame at a location that is spaced from the hinge connection of the second sub-frame with the main frame.

5. Locking apparatus as set forth in claim 4 including a tab that extends transversely from the bar at a location that is spaced from the side of the second sub-frame.

6. Locking apparatus as set forth in claim 5 in which the tab extends from the bar in a direction that is toward the hinge axis of the hinge connection of the second sub-frame with the main frame.

7. Locking apparatus as set forth in claim 6 including a frangible connection connecting the tab with the bar to allow the tab to be severed from the bar at the frangible connection.

8. Locking apparatus as set forth in claim 5 including a frangible connection connecting the tab with the bar to allow the tab to be severed from the bar at the frangible connection.

9. Locking apparatus as set forth in claim 2 including a catch connection for catching the main frame and the first sub-frame as the first sub-frame pivots about its hinge connection with the main frame into the attaching position, the catch connection comprising a tab for lodging in a slot as the first sub-frame pivots into the attaching position.

10. For use with a circuit breaker assembly having an operating handle that is movable within an aperture in a casing of the assembly to plural positions for operating the circuit breaker assembly to corresponding states of operation, a locking apparatus for selectively preventing the handle from being operated from one of the positions to another of the positions, the locking apparatus comprising:

attachment frame structure comprising first and second attachment frame parts providing an open center, for attaching to the casing at the aperture with the open center in registration with the aperture and with the handle;

a sub-frame part comprising a blocking member for blocking operation of the handle from the one position to the another position;

a hinge connection between the attachment frame structure and the sub-frame part providing for the sub-frame part to be selectively pivoted relative to the attachment frame structure about a hinge axis to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position;

wherein the sub-frame part comprises a side that extends radially from its hinge connection with the attachment frame structure, and the blocking member comprises a bar that extends transversely from the side of the sub-frame part at a location that is spaced from the hinge connection of the sub-frame part with the attachment frame structure; and further including a tab that extends transversely from the bar at a location that is spaced from the side of the sub-frame part, and a frangible connection connecting the tab with the bar to allow the tab to he severed from the bar at the frangible connection.

11. Locking apparatus as set forth in claim 10 in which the tab extends from the bar in a direction that is toward the hinge axis of the hinge connection of the sub-frame part with the attachment frame structure.

12. For use with a circuit breaker assembly having an operating handle that is movable within an aperture in a casing of the assembly to plural positions for operating the circuit breaker assembly to corresponding states of operation, a locking apparatus for selectively preventing the handle from being operated from one of the positions to another of the positions, the locking apparatus comprising:

attachment frame structure comprising first and second attachment frame parts providing an open center, for attachment to the casing at the aperture with the open center in registration with the aperture and with the handle;

a sub-frame part comprising a blocking member for blocking operation of the handle from the one position to the another position;

a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position;

wherein the blocking member comprises a bar that is disposed transverse to a direction of operation of the operating handle from the one position to the another position; and further including a tab that extends transversely from the bar in registration with the aperture and a frangible connection connecting the tab with the bar to allow the tab to be severed from the bar at the frangible connection.

13. For use with a circuit breaker assembly having an operating handle that is movable within an aperture in a casing of the assembly to plural positions for operating the circuit breaker assembly to corresponding states of operation, a locking apparatus for selectively preventing the handle from being operated from one of the positions to another of the positions, the locking apparatus comprising:

attachment frame structure, comprising an open center, for attaching to the casing at the aperture with the open center in registration with the aperture and with the handle;

a sub-frame part comprising a blocking member for blocking operation of the handle from the one position to the another position;

a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position;

the attachment frame structure comprising two attachment frame parts, the two attachment frame parts including a connection providing for their selective manipulation to an attaching position for attaching the attachment frame structure to the casing with the open center in registration with both the aperture and the handle, and to a non-attaching position for allowing the attachment frame structure to be detached from the casing; and the connection between the two attachment frame parts comprising a hinge connection for pivotally connecting the two attachment frame parts for their manipulation between the attaching and non-attaching positions, and a catch connection for catching one of the two attachment frame parts to the other of the two attachment frame parts as the two attachment frame parts pivot into the attaching position, the catch connection comprising a tab on one of the two attachment frame parts and a slot in the other of the two attachment frame parts, the tab lodging in the slot as the two attachment frame parts pivot into the attaching position.

14. Circuit breaker and locking apparatus comprising:

an assembly comprising a circuit breaker having an operating handle that is movable to plural positions for operating the circuit breaker to corresponding states of operation; and locking apparatus, attached to the assembly, for selectively preventing the handle from being operated from one of the positions to another of the positions;

the locking apparatus comprising a main frame having an open center disposed in registration with the handle, a first sub-frame, and a second sub-frame;

the first sub-frame comprising an open center that is in registration with the open center of the main frame;

the main frame and the first sub-frame providing a detachable attachment of the locking apparatus to the assembly, including a connection between the main frame and the first sub-frame providing for the first sub-frame to be selectively manipulated relative to the main frame for detaching the locking apparatus from the assembly;

the second sub-frame comprising a blocking member for blocking operation of the handle from the one position to the another position;

a hinge connection between the main frame and the second sub-frame providing for the second sub-frame to be selectively pivoted on the main frame for swinging motion relative both to the main frame and to the first sub-frame, while both the main frame and the first sub-frame reside in attachment of the locking apparatis to the assembly, to a blocking position wherein the blocking member is disposed in registration with the open centers of the main frame and the first sub-frame and in blocking relationship to the operating handle for blocking operation of the handle from the one position to the another position, and to a non-blocking position wherein the blocking member is disposed in non-blocking relationship to the handle for allowing operation of the handle from the one position to the another position.

15. Circuit breaker and locking apparatus as set forth in claim 14 in which the connection between the main frame and the first sub-frame providing for the first sub-frame to be selectively manipulated relative to the main frame comprises a hinge connection between the first sub-frame and the main frame providing for the first sub-frame to be selectively pivoted relative to the main frame, and the hinge connection between the first sub-frame and the main frame and the hinge connection between the second sub-frame and the main frame comprise respective hinge axes that are mutually parallel and are spaced apart along a direction of operation of the operating handle from the one position to the another position.

16. Circuit breaker and locking apparatus as set forth in claim 15 in which the main frame, the first sub-frame, and the second sub-frame comprise respective hole patterns that are in registration for allowing a bail of a locking device to be passed through registering holes in the main frame, the first sub-frame, and the second sub-frame to prevent the first sub-frame from being pivoted about its hinge connection with the main frame and the second sub-frame from being pivoted from blocking position.

17. Circuit breaker and locking apparatus as set forth in claim 15 in which the second sub-frame comprises a side that extends radially from its hinge connection with the main frame, and the blocking member comprises a bar that extends transversely from the side of the second sub-frame at a location that is spaced from the hinge connection of the second sub-frame with the main frame.

18. Circuit breaker and locking apparatus as set forth in claim 17 including a tab that extends transversely from the bar at a location that is spaced from the side of the second sub-frame.

19. Circuit breaker and locking apparatus as set forth in claim 18 in which the tab extends from the bar in a direction that is toward the hinge axis of the hinge connection of the second sub-frame with the main frame.

20. Circuit breaker and locking apparatus as set forth in claim 19 including a frangible connection connecting the tab with the bar to allow the tab to be severed from the bar at the frangible connection.

21. Circuit breaker and locking apparatus as set forth in claim 18 including a frangible connection connecting the tab with the bar to allow the tab to be severed from the bar at the frangible connection.

22. Circuit breaker and locking apparatus as set forth in claim 15 in which the main frame and the first sub-frame comprise a catch connection that catches the main frame and the first sub-frame, the catch connection comprising a tab lodged in a slot.

23. Circuit breaker and locking apparatus as set forth in claim 15 in which the circuit breaker comprises a casing having an aperture within which the operating handle is movable to the plural positions, and the main frame and the first sub-frame removably attach the locking apparatus to the casing at the aperture.

24. Circuit breaker and locking apparatus comprising:

an assembly comprising a circuit breaker having an operating handle that is movable to plural positions for operating the circuit breaker to corresponding states of operation; and locking apparatus for preventing the handle from being operated from one of the positions to another of the positions;

the locking apparatus comprising attachment frame structure that comprises first and second frame parts providing an open center in registration with the handle;

the locking apparatus further comprising a sub-frame part comprising a blocking member for blocking operation of the handle from the one position to the another position; a hinge connection between the attachment frame structure and the sub-frame part providing for the sub-frame part to be selectively pivoted relative to the attachment frame structure about a hinge axis to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position;

wherein the sub-frame part comprises a side that pivots about its hinge connection with the attachment frame structure and the blocking member comprises a bar that extends transversely from the side at a location spaced from the hinge connection of the sub-frame part with the attachment frame structure; and further including a tab that extends transversely from the bar at a location that is spaced from the side of the sub-frame part, and a frangible connection connecting the tab with the bar to allow the tab to be severed from the bar at the frangible connection.

25. Locking apparatus as set forth in claim 24 in which the tab extends from the bar in a direction that is toward the hinge axis of the hinge connection of the sub-frame part with the attachment frame structure.

26. Locking apparatus as set forth in claim 24 in which in which the circuit breaker comprises a casing having an aperture within which the operating handle is movable to the plural positions, and the attachment frame structure removably attaches the locking apparatus to the casing at the aperture.

27. Circuit breaker and locking apparatus comprising:

an assembly comprising a circuit breaker having an operating handle that is movable to plural positions for operating the circuit breaker to corresponding states of operation; and locking apparatus for preventing the handle from being operated from one of the positions to another of the positions;

the locking apparatus comprising attachment frame structure comprising first and second attachment frame parts providing an open center in registration with the handle;

the locking apparatus further comprising a sub-frame part comprising a blocking member for blocking operation of the handle from the one position to the another position; a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position;

wherein the blocking member comprises a bar that extends transverse to a direction of operation of the operating handle from the one position to the another position; and further including a tab that extends transversely from the bar and a frangible connection connecting the tab with the bar to allow the tab to be severed from the bar at the frangible connection.

28. Locking apparatus as set forth in claim 27 in which in which the circuit breaker comprises a casing having an aperture within which the operating handle is movable to the plural positions, and the attachment frame structure removably attaches the locking apparatus to the casing at the aperture.

29. Circuit breaker and locking apparatus comprising:

a circuit breaker assembly comprising a casing having an aperture and an operating handle that is movable within the aperture to plural positions for operating the circuit breaker assembly to corresponding states of operation; and locking apparatus for selectively preventing the handle from being operated from one of the positions to another of the positions;

the locking apparatus comprising attachment frame structure that removably attaches the locking apparatus to the casing at the aperture, the attachment frame structure comprising an open center in registration with the aperture and with the handle;

the locking apparatus further comprising a sub-frame part comprising a blocking member for blocking operation of the handle from the one position to the another position; a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position;

the attachment frame structure comprising two attachment frame parts, and a connection between the two attachment frame parts providing for their selective manipulation to allow the locking apparatus to be detached from the casing; and the connection between the two attachment frame parts comprising a hinge connection that provides pivotal motion between the two attachment frame parts for their manipulation to allow detachment of the locking apparatus from the casing and a catch connection that catches one of the two attachment frame parts to the other of the two attachment frame parts and that comprises a tab of the one attachment frame part lodged in a tab-receiving slot of the other attachment frame part.

30. Circuit breaker and locking apparatus comprising:

an assembly comprising a circuit breaker assembly having an operating handle that is movable to plural positions for operating the circuit breaker to corresponding states of operation; and locking apparatus for preventing the handle from being operated from one of the positions to another of the positions;

the locking apparatus comprising attachment frame structure, comprising an open center in registration with the handle; a sub-frame part comprising a blocking member for blocking operation of the handle from the one position to the another position; a connection between the attachment frame structure and the sub-frame part providing for the sub-frame part to be selectively manipulated relative to the attachment frame structure to a blocking position wherein the blocking member is disposed in registration with the open center of the attachment frame structure and in blocking relationship to the operating handle for blocking operation of the handle from the one position to the another position, and to a non-blocking position wherein the blocking member is disposed in non-blocking relationship to the handle for allowing operation of the handle from the one position to the another position;

wherein the blocking member comprises a bar that extends transverse to a direction of operation of the operating handle from the one position to the another position; and further including a tab that extends transversely from the bar and a frangible connection connecting the tab with the bar to allow the tab to be severed from the bar at the frangible connection.

* * * * *